US007552773B2

(12) United States Patent
Wright et al.

(10) Patent No.: US 7,552,773 B2
(45) Date of Patent: Jun. 30, 2009

(54) MULTICYCLE HYDRAULIC CONTROL VALVE

(75) Inventors: Adam Wright, McKinney, TX (US); Roger L. Schultz, Ninnekah, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 307 days.

(21) Appl. No.: 11/199,093

(22) Filed: Aug. 8, 2005

(65) Prior Publication Data

US 2007/0029078 A1 Feb. 8, 2007

(51) Int. Cl.
*E21B 34/10* (2006.01)
*F16K 31/12* (2006.01)

(52) U.S. Cl. ..... 166/319; 166/374; 166/386; 251/30.01

(58) Field of Classification Search ..... 166/53, 166/319, 373, 321, 332.1, 334.1, 374, 386; 251/25, 30.01, 31, 157, 174, 176, 186, 333
See application file for complete search history.

(56) References Cited

U.S. PATENT DOCUMENTS 3,092,135 A * 6/1963 Brown et al. ..... 137/458
3,533,430 A * 10/1970 Fredd ..... 137/112
4,059,157 A * 11/1977 Crowe ..... 166/317
4,421,174 A 12/1983 McStravick et al.
4,633,952 A 1/1987 Ringgenberg
4,922,423 A 5/1990 Koomey et al.
4,986,357 A 1/1991 Pringle
5,050,681 A 9/1991 Skinner
5,101,907 A 4/1992 Schultz et al.
5,127,477 A 7/1992 Schultz
5,234,057 A 8/1993 Schultz et al.
5,238,018 A * 8/1993 Hashida ..... 137/112
5,238,070 A 8/1993 Schultz
5,251,703 A 10/1993 Skinner
5,273,113 A * 12/1993 Schultz ..... 166/374
5,412,568 A 5/1995 Schultz
5,890,542 A 4/1999 Ringgenberg
6,450,258 B2 9/2002 Green et al.
6,536,530 B2 3/2003 Schultz et al.
7,111,675 B2 9/2006 Zisk (Continued)

FOREIGN PATENT DOCUMENTS

EP 0500341 8/1992

(Continued)

OTHER PUBLICATIONS

Search Report for UK application GB 0410709.0.

(Continued)

*Primary Examiner*—Kenneth Thompson
(74) *Attorney, Agent, or Firm*—Marlin R. Smith

(57) ABSTRACT

A multicycle hydraulic control valve. A control and actuation system for a well tool includes a control valve having one or more metal-to-metal seals which open while differential pressure exists across the seals to thereby selectively connect pressure sources to an actuator to operate the well tool. Both seals may be closed while a connection between the actuator and the pressure sources is switched by the control valve. The control valve may include a member having areas formed thereon acted upon by various pressures to facilitate operation of the control valve.

20 Claims, 4 Drawing Sheets

U.S. PATENT DOCUMENTS

| | | | | |
|---|---|---|---|---|
| 7,201,230 | B2 * | 4/2007 | Schultz et al. | 166/373 |
| 2004/0226720 | A1 | 11/2004 | Schultz et al. | |

FOREIGN PATENT DOCUMENTS

| | | |
|---|---|---|
| EP | 0500343 | 8/1992 |
| EP | 0604156 | 12/1994 |
| WO | WO 03/021075 | 3/2003 |

OTHER PUBLICATIONS

Office Action for U.S. Appl. No. 10/438,793 dated Feb. 25, 2005.
Office Action for U.S. Appl. No. 10/438,793 dated Mar. 24, 2005.
Office Action for U.S. Appl. No. 10/438,793 dated Jul. 8, 2005.
Office Action for U.S. Appl. No. 10/438,793 dated Jan. 10, 2006.
Office Action for U.S. Appl. No. 10/438,793 dated Jun. 22, 2006.
Examination report dated Aug. 31, 2006 for UK application No. GB0410709.0.
Examination report for GB 0609150.8 dated Jun. 5, 2007.

* cited by examiner

MULTICYCLE HYDRAULIC CONTROL VALVE

BACKGROUND

The present invention relates generally to operations performed and equipment utilized in conjunction with a subterranean well and, in an embodiment described herein, more particularly provides a multicycle hydraulic control valve.

Various schemes and methods have been proposed for controlling actuation of well tools. Typically, these either require complex downhole plumbing, manipulation of downhole pressures in predefined patterns, use of seals which open while differential pressure exists across the seals (thereby damaging the seals due to erosion at high flow rates, tearing of the seals, etc.), or a combination of these. In particular, where seals are opened while differential pressure exists across the seals, only a limited number of actuation cycles may be accomplished before the seals begin to leak and prevent further controlled actuation of the well tool.

Therefore, it may be seen that improvements are needed in the art of well tool actuation and control. It is one of the objects of the present invention to provide such improvements.

SUMMARY

In carrying out the principles of the present invention, a control and actuation system is provided which solves at least one problem in the art. Examples are described below in which a control valve of the system is constructed so that it can withstand many actuation cycles without significant deterioration of its sealing capabilities.

In one aspect of the invention, a control and actuation system for a well tool is provided which includes a control valve having one or more metal-to-metal seals. The seals open while differential pressure exists across the seals to thereby selectively connect pressure sources to an actuator to operate the well tool.

In another aspect of the invention, a control and actuation system for a well tool is provided which includes a control valve which selectively connects pressure sources to an actuator to operate the well tool. The control valve includes metal-to-metal seals which isolate a chamber of the actuator from the respective pressure sources. The seals are closed while the control valve is operated between one configuration in which one of the pressure sources is connected to the actuator chamber, and another configuration in which another pressure source is connected to the actuator chamber.

In yet another aspect of the invention, a control and actuation system for a well tool is provided which includes a control valve which selectively connects pressure sources to an actuator to operate the well tool. The control valve includes seals which isolate a chamber of the actuator from the respective pressure sources, and a member which has one of the seals at least partially positioned thereon. The member further has opposing areas formed thereon. Pressure in the actuator chamber acts on one area to bias the member in a direction to open the seal or extend a mandrel or piston, and the actuator chamber pressure acts on the other area to bias the member in a direction to close the seal or retract the mandrel or piston.

These and other features, advantages, benefits and objects of the present invention will become apparent to one of ordinary skill in the art upon careful consideration of the detailed description below of representative embodiments of the invention and the accompanying drawings, in which similar elements are indicated in the various figures using the same reference numbers.

DETAILED DESCRIPTION

Figure 1:
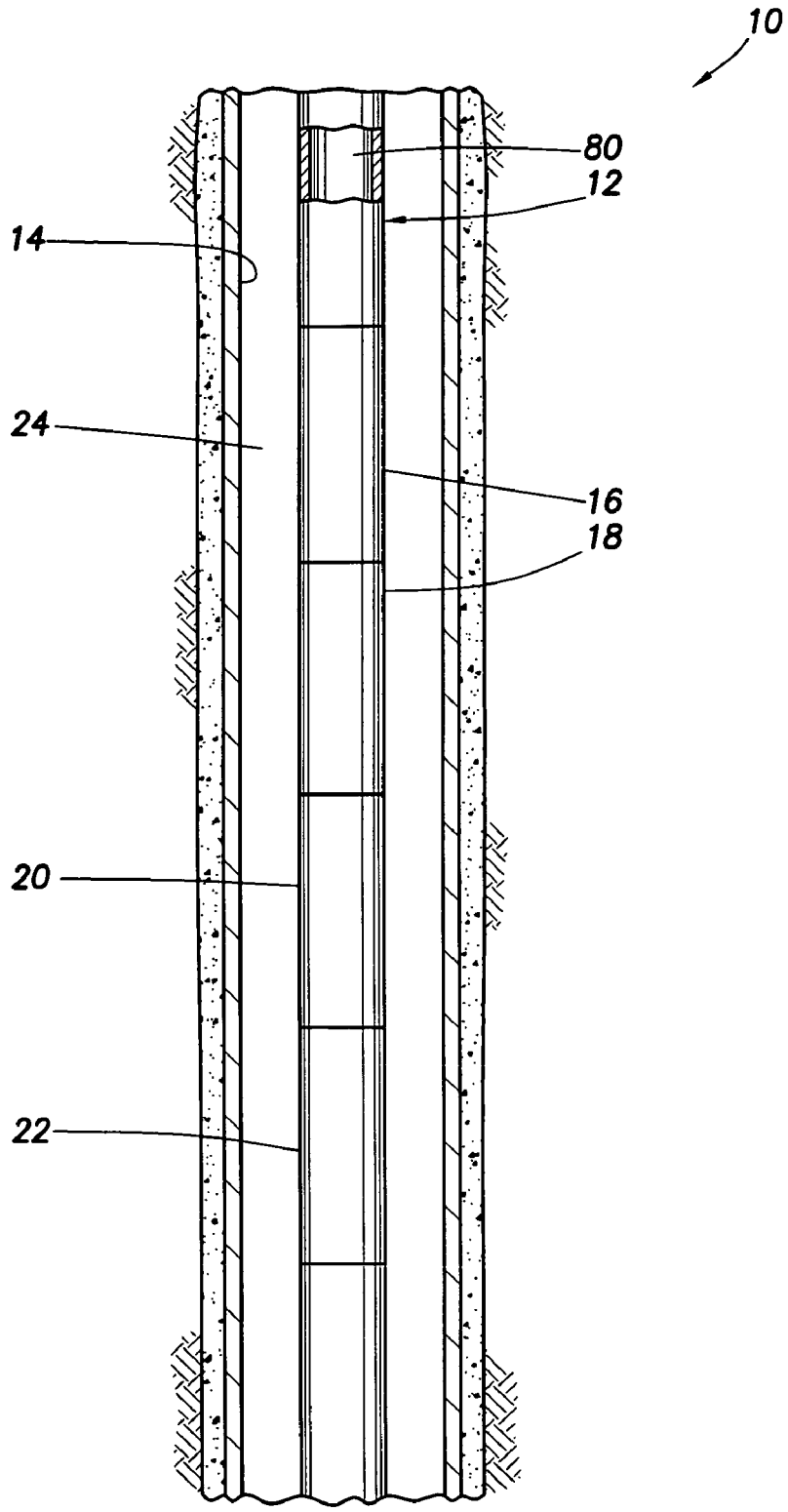
FIG. 1 is a schematic partially cross-sectional view of a well tool control and actuation system embodying principles of the present invention.

Representatively illustrated in FIG. 1 is a well tool control and actuation system 10 which embodies principles of the present invention. In the following description of the system 10 and other apparatus and methods described herein, directional terms, such as "above", "below", "upper", "lower", "rightward", "leftward", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As schematically depicted in FIG. 1, a tubular string 12 has been positioned in a wellbore 14. The tubular string 12 includes a pressure source 16, a control valve 18, an actuator 20 and a well tool 22. Although these elements of the tubular string 12 are shown and described herein as being separate portions of the tubular string, it will be readily appreciated that any or all of these could be combined if desired. For example, the actuator 20 and well tool 22 could be combined into a single element, the control valve 18 and actuator 20 could be combined into a single element, etc.

The well tool 22 could be any type of well tool. For example, the well tool 22 could be a valve, a packer, a well testing tool, a pump, an anchoring device and/or any other kind of well tool. In particular, the well tool 22 could be the ball valve described in U.S. patent application Ser. No. 10/438793, filed on May 15, 2003, the entire disclosure of which is incorporated herein by this reference.

The actuator 20 could be any type of actuator. Preferably, the actuator 20 operates in response to pressure applied thereto. As described more fully below, the actuator 20 preferably includes a piston to which a fluid pressure differential is applied to cause the piston to displace and thereby operate the well tool 22, but it should be clearly understood that any other kind of actuator may be used in keeping with the principles of the invention. The fluid pressure could be supplied hydraulically and/or pneumatically.

Multiple embodiments of the control valve 18 are described below. The control valve 18 is used to selectively connect the actuator 20 to various pressure sources, so that the appropriate pressure differential is applied to the piston of the actuator to cause a corresponding desired operation of the well tool 22. However, note that the principles of the invention are not limited to the embodiments of the control valve 18 described below.

The pressure source 16 is a source of relatively low or decreased pressure (e.g., an atmospheric chamber) relative to hydrostatic pressure in an annulus formed between the tubular string 12 and the wellbore 14 (the annulus serving as a relatively high or increased pressure source 24). However, the pressure source 16 could be a source of relatively high or increased pressure if desired.

Of course, many other types of pressure sources could be used in place of either or both of the pressure sources 16, 24. For example, the pressure source 16 or 24 could be a pump (which could supply either or both relatively increased and relatively decreased pressure), a pressure intensifier, a pressure reducer, a propellant charge, etc.

Furthermore, it is not necessary for either of the pressure sources 16, 24 to be interconnected in the tubular string. For example, either of the pressure sources 16, 24 could instead be an internal passage 80 extending longitudinally through the tubular string 12.

Figure 2:
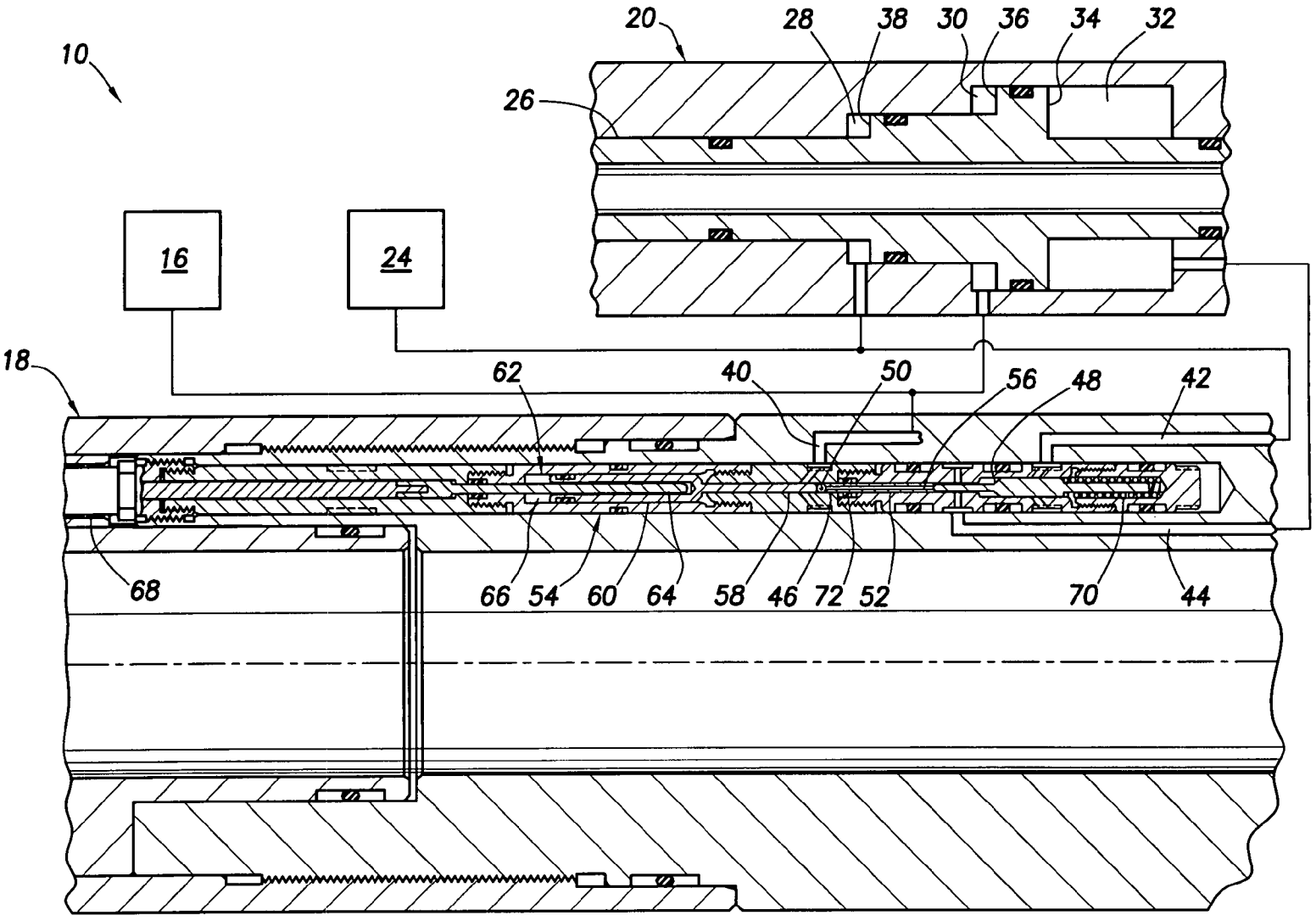
FIG. 2 is an enlarged scale cross-sectional and partially schematic view of portions of the control and actuation system of FIG. 1.

Referring additionally now to FIG. 2, another illustration of the actuation and control system 10 is depicted in which cross-sectional views of the actuator 20 and control valve 18 are shown, and the pressure sources 16, 24 are represented schematically. The well tool 22 is not illustrated in FIG. 2, but preferably the well tool is connected to a piston 26 of the actuator 20 so that displacement of the piston may be used to operate the well tool. However, it should be clearly understood that it is not necessary in keeping with the principles of the invention for the well tool 22 to be operated by piston displacement, since other ways of operating the well tool could be used instead.

The actuator 20 includes multiple chambers 28, 30, 32 to which various pressures are applied to cause displacement of the piston 26 when it is desired to operate the well tool 22. The chamber 28 is connected to the pressure source 24, the chamber 30 is connected to the pressure source 16, and the chamber 32 is connected at certain times to the pressure source 16, to the pressure source 24, or to neither of the pressure sources.

The piston 26 has a surface area 34 exposed to pressure in the chamber 32, such that pressure acting on the surface area biases the piston to the left as viewed in the figure. As depicted in FIG. 2, this surface area 34 is equal to the sum of surface areas 36, 38 on the piston 26 exposed to pressure in the respective chambers 30, 28.

It will be readily appreciated by those skilled in the art that when the chamber 32 is connected to the relatively lower pressure source 16, the net biasing force applied to the piston 26 due to the arrangement of the surface areas 34, 36, 38 will tend to displace the piston to the right as viewed in FIG. 2. Conversely, when the chamber 32 is connected to the relatively higher pressure source 24, the net biasing force applied to the piston 26 due to the arrangement of the surface areas 34, 36, 38 will tend to displace the piston to the left.

In this manner, the piston 26 may be displaced in different directions to produce corresponding different operations of the well tool 22. Note, however, that it is not necessary for the piston 26 to have the arrangement of surface areas 34, 36, 38 described above, or for the pressure sources 16, 24 to be connected to the chambers 28, 30, 32 as described above, since many other configurations and ways of operating the actuator 20 could be used in keeping with the principles of the invention.

The control valve 18 is used to control which, if any, of the pressure sources 16, 24 is connected to the chamber 32 of the actuator 20. For this purpose, the control valve 18 includes a passage 40 connected to the pressure source 16, a passage 42 connected to the pressure source 24, and a passage 44 connected to the chamber 32.

Figure 3:
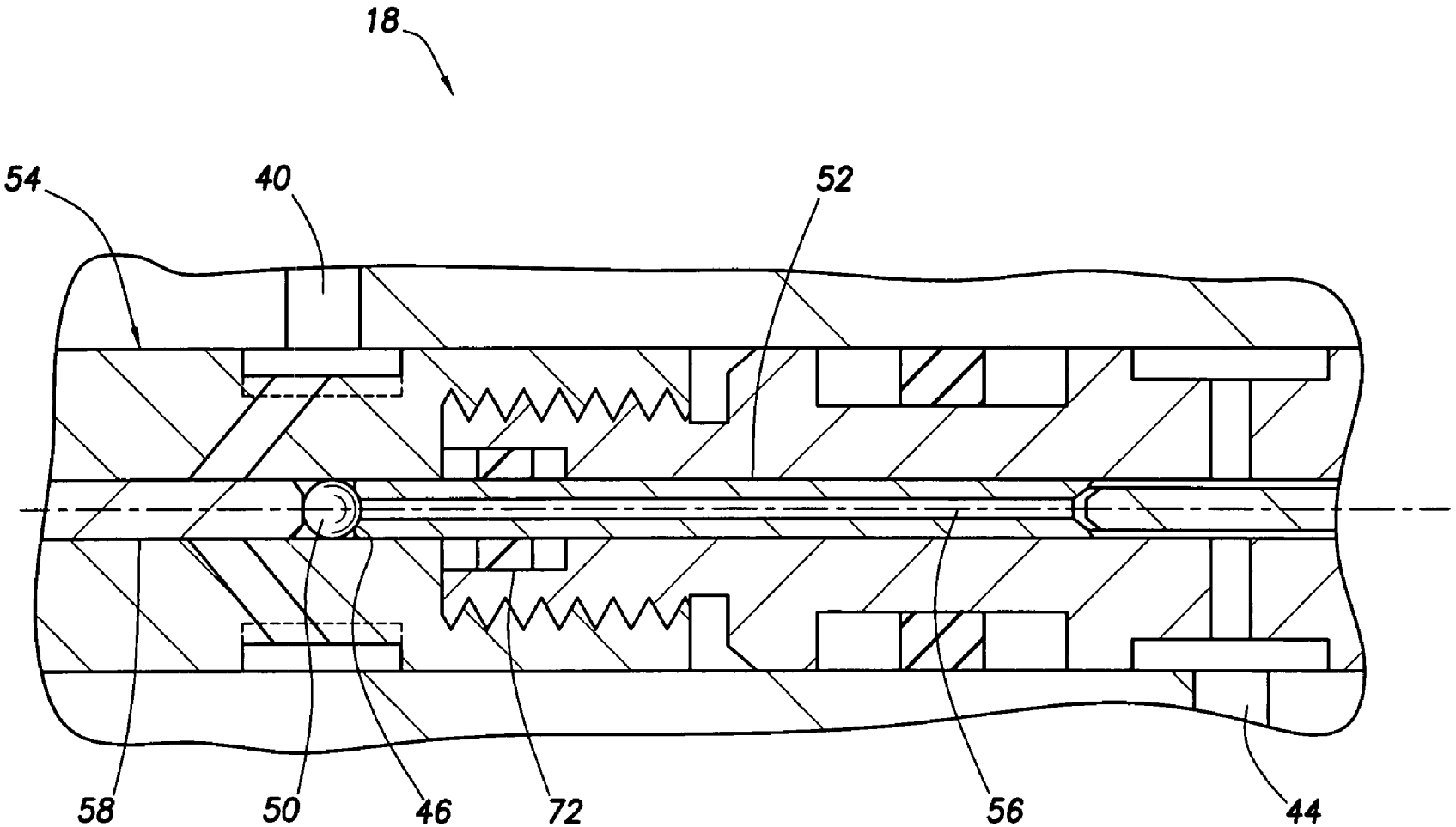
FIG. 3 is a further enlarged scale view of a control valve portion of the control and actuation system.

A metal-to-metal seal 46 is used to selectively isolate the passages 40, 44 from each other, and another metal-to-metal seal 48 is used to selectively isolate the passages 42, 44 from each other. An enlarged cross-sectional view is depicted in FIG. 3, wherein it may be seen that the seal 46 is formed at an interface between a metal ball 50 and a concave end of an elongated member 52.

The member 52 is reciprocably received in a poppet housing assembly 54 of the control valve 18, and has a passage 56 formed therein. When the ball 50 is biased sufficiently into contact with the end of the member 52 (thereby closing the seal 46), the passages 40, 44 are isolated from each other, but when the ball is not biased into contact with the end of the member 52 (thereby opening the seal 46), the passages 40, 44 are connected to each other via the passage 56 in the member 52.

A rod 58 is used to bias the ball 50 into contact with the member 52. The rod 58 is attached to a piston 60, which is part of a pressure intensifier 62 of the control valve 18. The pressure intensifier 62 includes a plunger 64 which displaces into and out of a chamber 66 to thereby respectively increase and decrease pressure in the chamber 66.

The plunger 64 has a net surface area exposed to the chamber 66 which is significantly smaller than a net surface area of the piston 60 exposed to the chamber. Preferably, the ratio of these areas is about 1:10, so that a biasing force used to displace the plunger 64 into the chamber 66 is multiplied by a factor of ten into a force biasing the piston 60 (and the rod 58) toward the ball 50. Of course, other ratios of areas and forces may be used in the pressure intensifier 62 as desired.

An electrical motor-powered linear actuator 68 is used to displace the plunger 64 into and out of the chamber 66. Other types of actuators, and other ways of displacing the plunger 64 may be used, in keeping with the principles of the invention.

The seal 48 is formed at an interface between the member 52 and the housing assembly 54. The seal 48 is closed by biasing the member 52 leftward into sealing contact with the housing assembly 54 as described more fully below.

When the rod 58 biases the ball 50 into contact with the member 52, the seal 46 closes (as described above) and then increased biasing force displaces the member 52 to the right as viewed in FIG. 2. This rightward displacement of the member 52 opens the seal 48, thereby connecting the passages 42, 44 as depicted in FIG. 2. Note that, at a point in time during which sufficient biasing force has been applied to the ball 50 by the rod 58 to close the seal 46, but sufficient force has not yet been applied to the member 52 to displace it rightward and open the seal 48, both of the seals 46, 48 are closed, thereby isolating the chamber 32 from both of the pressure sources 16, 24 and isolating the pressure sources from each other.

Prior to the seal 48 being opened, the member 52 is biased leftward by a combination of forces, thereby biasing the member into sealing contact with the housing assembly 54 and maintaining the seal closed. A biasing device 70 (such as a coil spring as depicted in FIG. 2, or a gas charge, etc.) exerts a leftward biasing force on the member 52, as does a differential between pressures in the passages 42, 44. Pressure in the passage 42 (from the pressure source 24) is greater than pressure in the passage 44 (from the chamber 32, previously connected to the pressure source 16), and so the pressure differential biases the member 52 leftward prior to the seal 48 being opened.

With the seal 48 open as depicted in FIG. 2, the passages 42, 44 are connected to each other, the chamber 32 is thereby connected to the pressure source 24 and the actuator piston 26 is biased to the left. To bias the piston 26 to the right, the member 52 is displaced back to the left to close the seal 48 and then open the seal 46.

The member 52 is displaced to the left by using the actuator 68 to displace the plunger 64 to the left, thereby decreasing pressure in the chamber 66. Reduced pressure in the chamber 66 permits the piston 60 and rod 58 to displace to the left, decreasing the biasing force applied to the ball 50 by the rod.

As this biasing force decreases, the member 52 begins to displace to the left. The member 52 is biased leftward by a combination of forces—the force exerted by the biasing device 70 and a biasing force due to a pressure differential across a seal 72 isolating the relatively greater pressure in the passages 42, 44 applied to the member 52 to the right of the seal from the relatively lesser pressure in the passage 40 applied to the member to the left of the seal.

When the member 52 has displaced sufficiently far to the left, it will contact the housing assembly 54 and close the seal 48. A further decrease in the biasing force applied to the ball 50 by the rod 58 will eventually permit the seal 46 to open, thereby connecting the passages 40, 44 to each other and thereby connecting the chamber 32 to the pressure source 16. The chamber 32 can be again connected to the pressure source 24 when desired by displacing the member 52 to the right to thereby close the seal 46 and open the seal 48 as described above.

Again, note that both of the seals 46, 48 are closed between the time the passage 44 is connected to the passage 42 and the time the passage 44 is connected to the passage 40 while the member 52 displaces leftward or rightward. In addition, note that each time each of the seals 46, 48 is opened a differential pressure exists across the respective seal.

For this reason, the seals 46, 48 are preferably metal-to-metal seals, but other types of seals which are resistant to damage due to erosion, tearing, etc. when opened with differential pressure across the seals may be used. Preferably, the control valve 18 includes no polymer seals (elastomers, non-elastomers, plastics, composites of polymers and non-polymers, etc.) which open while differential pressure exists across the seals.

Figure 4:
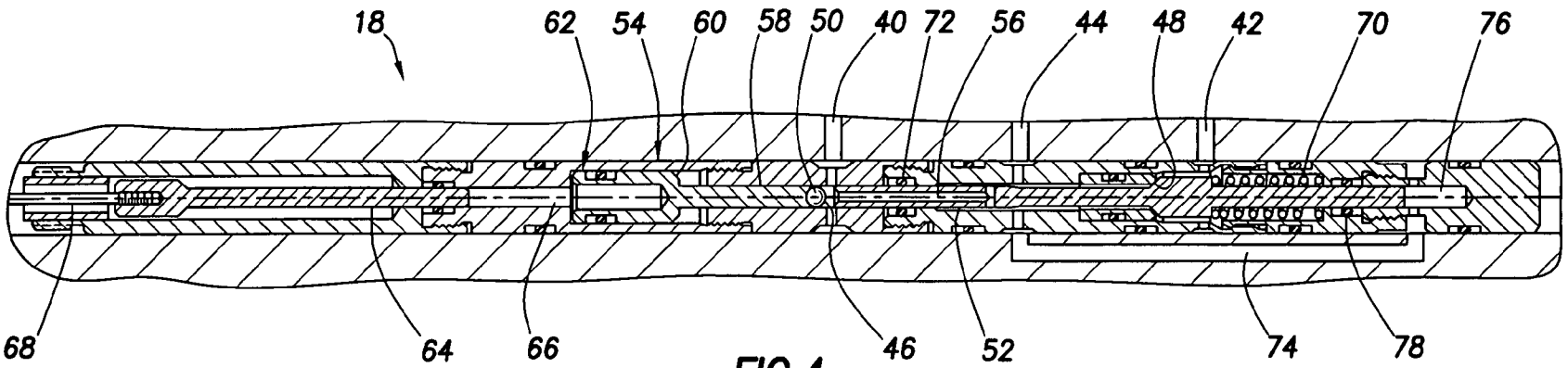
FIG. 4 is a cross-sectional view of an alternate construction of a control valve of the control and actuation system, the control valve being shown in a first configuration.
Figure 5:
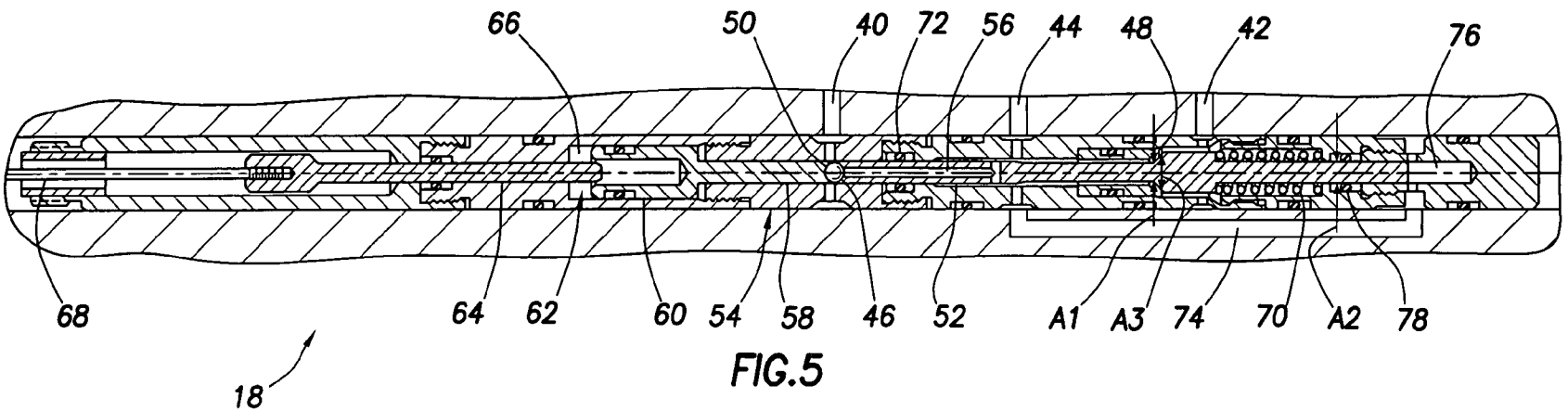
FIG. 5 is a cross-sectional view of the alternate construction of the control valve, the control valve being shown in a second configuration.

Referring additionally now to FIGS. 4 & 5, an alternate construction of the control valve 18 is representatively illustrated. This alternate construction is similar in many respects to the construction depicted in FIGS. 2 & 3 and described above, and so the same reference numbers are used in FIGS. 4 & 5 to indicate similar elements.

The control valve 18 as shown in FIGS. 4 & 5 differs in at least one significant respect from that described above, in that a passage 74 is used to connect a chamber 76 exposed to an end of the member 52 to the chamber 32 in the actuator 20 via the passage 44. Of course, the chambers 32, 76 could be otherwise connected to each other in keeping with the principles of the invention.

This use of the chamber 76 connected to the chamber 32 produces a beneficial change in the manner in which the member 52 is biased to displace relative to the housing assembly 54 to open and close the seal 48, and to maintain the seal 46 closed when desired. In particular, the biasing force which is applied by the actuator 68 to produce displacement of the member 52 may be reduced, and the piston areas formed on the member may be optimized for a particular application so that sufficient biasing force is available to close the seals 46, 48 without requiring the actuator 68 to exert an inordinately large force to displace the member.

In the configuration depicted in FIG. 4, the seal 46 is open (permitting communication between the passages 40, 44), but the seal 48 is closed (isolating the passages 42, 44 from each other). The passage 74 connects the chamber 76 to the passage 40.

Since the passage 40 is connected to the relatively low pressure source 16, the chamber 76 is also connected to the low pressure source, as is the passage 44. Thus, to the left of the seal 48 the member 52 is exposed to the relatively low pressure, to the right of a seal 78 isolating the chamber 76 from the passage 42 the member is also exposed to the relatively low pressure, and between the seals 46, 78 the member is exposed to the relatively high pressure source 24.

The seal 48 forms a net surface area A1 on the member 52 which is exposed to the relatively low pressure to the left of the seal, which acts on the surface area to bias the member in a direction to open the seal 48. The seal 78 forms a net surface area A2 on the member 52 which is exposed to the relatively low pressure to the right of the seal 78, which acts on the surface area to bias the member in a direction to close the seal 48.

Because the relatively high pressure also acts in opposite directions on the surface areas formed by the seals 48, 78, and the area A1 (formed at the seal 48) is greater than the area A2 (formed at the seal 78), a net biasing force on the member 52 to the left is produced, acting to bias the seal 48 closed. This biasing force, in combination with the leftward biasing force exerted by the biasing device 70 is exceeded by the rightward biasing force exerted on the member 52 by the rod 58 via the ball 50 when it is desired to open the seal 48.

It will be readily appreciated by those skilled in the art that the areas A1, A2 formed at the seals 48, 78 may be adjusted to change the rightward biasing force which must be exerted on the member 52 to displace it and open the seal 48. For example, the area A1 could be increased or the area A2 could be decreased to increase the required rightward biasing force, or the area A1 could be decreased or the area A2 could be increased to decrease the required rightward biasing force.

In this manner, the control valve 18 can be constructed so that the required rightward biasing force does not exceed the capability of the actuator 68 and pressure intensifier 62 to displace the member 52 to open the seal 48. However, when it is desired for the seal 48 to remain closed, the combined leftward biasing force applied to the member 52 should still be large enough to maintain the seal 48 closed without leakage.

Note that, when the seal 48 is closed, and the area A1 is formed at the seal exposed to the relatively low pressure to the left of the seal as depicted in FIG. 4, the seal itself may be formed across a surface area at the interface between the member 52 and the housing assembly 54. Thus, the relatively high pressure to the right of the seal 48 could act on a net surface area A3 which is somewhat greater than the area A1, although preferably these areas are approximately equal.

In the configuration depicted in FIG. 5, the member 52 has been displaced rightward after closing the seal 46. This rightward displacement of the member 52 has opened the seal 48. The chamber 32 is now connected to the passage 42, and the second area to the right of the seal 78 is now exposed to the relatively high pressure.

The member 52 is thus pressure balanced at the seals 48, 78, but a pressure differential exists across the seal 72. This pressure differential biases the member 52 to the left and into contact with the ball 50, maintaining the seal 46 closed.

It may now be fully appreciated that the system 10 with the control valve 18 produces a variety of benefits in controlling actuation of the well tool 22. For example, the control valve 18 is compact (it may be constructed to fit in a ½ in. diameter or smaller bore), relatively uncomplicated in design, capable of performing many cycles at relatively high pressure differentials without damage, may be adjusted so that its actuator 68 is matched appropriately to the pressure differentials applied to the member 52, and the control valve uses metal-to-metal seals instead of polymer seals where the seals are opened with differential pressure across the seals.

It will also be appreciated that the control valve 18 may be utilized in actuation control systems other than the system 10 described above. For example, where an actuator includes a piston having opposing piston areas, a first control valve could be used to control application of pressure from a selected one of relatively high and low pressure sources to one of the piston areas, and a second control valve could be used to control application of pressure from a selected one of the relatively high and low pressure sources to the other of the piston areas. In this manner, the piston could be displaced in one direction by using the first control valve to apply greater pressure to one piston area while the second control valve is used to apply lesser pressure to the other piston area, and the piston could be displaced in an opposite direction by using the first control valve to apply lesser pressure to one piston area while the second control valve is used to apply greater pressure to the other piston area. The control valves could also be used to equalize pressure (using pressure from either the high or low pressure source) applied to the piston areas, for example, to cease displacement of the piston at either end of its stroke or at a position therebetween.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A control and actuation system for a well tool, the system comprising:

a control valve including one or more metal-to-metal seals which open while differential pressure exists across the seals to thereby selectively connect first and second pressure sources to an actuator to operate the well tool, the first and second pressure sources being disposed downhole with the actuator, and wherein the metal-to-metal seals include first and second seals, each of the first and second seals being operable to close and thereby isolate a chamber of the actuator from a respective one of the first and second pressure sources.

2. The system of claim 1, wherein the control valve is devoid of any polymer seal which opens to operate the well tool while differential pressure exists across the polymer seal.

3. The system of claim 1, wherein the control valve includes only the metal-to-metal seals which open while differential pressure exists across the seals.

4. A control and actuation system for a well tool, the system comprising:

a control valve including one or more metal-to-metal seals which open while differential pressure exists across the seals to thereby selectively connect first and second pressure sources to an actuator to operate the well tool, wherein the metal-to-metal seals include first and second seals, each of the first and second seals being operable to close and thereby isolate a chamber of the actuator from a respective one of the first and second pressure sources, and wherein the control valve is operable between a first configuration in which the first seal is opened to connect the first pressure source to the chamber and a second configuration in which the second seal is opened to connect the second pressure source to the chamber, and wherein both of the first and second seals are closed when the control valve is between the first and second configurations.

5. The system of claim 4, wherein the control valve includes a member which has the second seal at least partially positioned thereon, the member further having first and second opposing areas formed thereon, wherein pressure in the actuator chamber acts on the first area to bias the member in a direction to open the second seal, and wherein the actuator chamber pressure acts on the second area to bias the member in a direction to close the second seal.

6. The system of claim 5, wherein the first area is greater than the second area.

7. The system of claim 5, wherein the control valve member further has a third area formed thereon, and wherein pressure supplied by the second pressure source acts on the third area to bias the member in the direction to close the second seal.

8. The system of claim 7, wherein the third area is approximately equal to the first area.

9. A control and actuation system for a well tool, the system comprising:

a control valve including one or more metal-to-metal seals which open while differential pressure exists across the seals to thereby selectively connect first and second pressure sources to an actuator to operate the well tool, the first and second pressure sources being disposed downhole with the actuator, wherein pressure supplied by the first pressure source is less than pressure supplied by the second pressure source, and wherein the second pressure source is a selected one of an internal passage of a tubular string and an annulus between the tubular string and a wellbore.

10. A control and actuation system for a well tool, the system comprising:

a control valve which selectively connects first and second pressure sources to an actuator to operate the well tool, the control valve including at least first and second metal-to-metal seals which isolate a chamber of the actuator from the respective first and second pressure sources, and wherein both of the first and second seals are closed while the control valve is operated between a first configuration in which the first pressure source is connected to the actuator chamber and a second configuration in which the second pressure source is connected to the actuator chamber.

11. The system of claim 10, wherein each of the first and second seals opens while a differential pressure exists across the respective seal.

12. The system of claim 10, wherein the control valve is devoid of any polymer seal which opens to operate the well tool while a differential pressure exists across the polymer seal.

13. The system of claim 10, wherein the control valve includes a member which has the second seal at least partially positioned thereon, the member further having first and second opposing areas formed thereon, wherein pressure in the actuator chamber acts on the first area to bias the member in a direction to open the second seal, and wherein the actuator chamber pressure acts on the second area to bias the member in a direction to close the second seal.

14. The system of claim 13, wherein the first area is greater than the second area.

15. A control and actuation system for a well tool, the system comprising:

a control valve which selectively connects first and second pressure sources to an actuator to operate the well tool, the control valve including at least first and second seals which isolate a chamber of the actuator from the respective first and second pressure sources, and a member which has the second seal at least partially positioned thereon, the member further having first and second opposing areas formed thereon, wherein pressure in the actuator chamber acts on the first area to bias the member in a direction to open the second seal, and wherein the actuator chamber pressure acts on the second area to bias the member in a direction to close the second seal.

16. The system of claim 15, wherein the first area is greater than the second area.

17. The system of claim 15, wherein the control valve member further has a third area formed thereon, and wherein pressure supplied by the second pressure source acts on the third area to bias the member in the direction to close the second seal.

18. The system of claim 15, wherein the first and second seals are metal-to-metal seals, each of which opens while differential pressure exists across the respective seal.

19. The system of claim 15, wherein both of the first and second seals are closed while the control valve is operated between a first configuration in which the first pressure source is connected to the actuator chamber and a second configuration in which the second pressure source is connected to the actuator chamber.

20. The system of claim 15, further comprising at least first and second ones of the control valve, and wherein the actuator includes a piston having first and second opposing piston areas, the first control valve selectively connecting the first and second pressure sources to the first piston area, and the second control valve selectively connecting the first and second pressure sources to the second piston area.

* * * * *